US007132989B1

(12) United States Patent
Poilasne

(10) Patent No.: US 7,132,989 B1
(45) Date of Patent: Nov. 7, 2006

(54) APPARATUS, SYSTEM, AND METHOD FOR ADJUSTING ANTENNA CHARACTERISTICS USING TUNABLE PARASITIC ELEMENTS

(75) Inventor: Gregory Poilasne, San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 0 days.

(21) Appl. No.: 11/122,658

(22) Filed: May 4, 2005

(51) Int. Cl.
*H01Q 9/00* (2006.01)

(52) U.S. Cl. ..... 343/745; 343/702

(58) Field of Classification Search ..... 343/702, 343/700 MS, 745, 833, 834
See application file for complete search history.

(56) References Cited

U.S. PATENT DOCUMENTS 3,046,551 A * 7/1962 Ratkevich ..... 343/778
6,456,250 B1 * 9/2002 Ying et al. ..... 343/702
6,518,920 B1 2/2003 Proctor, Jr. et al.
6,600,456 B1 7/2003 Gothard et al.
6,765,536 B1 * 7/2004 Phillips et al. ..... 343/702

* cited by examiner

*Primary Examiner*—Tan Ho

(57) ABSTRACT

An apparatus, system and method optimize antenna performance using tunable parasitic elements by changing antenna characteristics based on signal quality parameters of electromagnetic signals exchanged through the antenna. The tunable parasitic elements are responsive to control signals to modify current flowing through a counterpoise of the antenna. Based on signal quality parameters received from a communication system, transmission characteristics are optimized by increasing the transmission gain in the direction of the receiving base station. Signal quality parameters measured at the antenna are used to change reception characteristics by minimizing reception gain in the direction of a jamming transmitter.

21 Claims, 6 Drawing Sheets

APPARATUS, SYSTEM, AND METHOD FOR ADJUSTING ANTENNA CHARACTERISTICS USING TUNABLE PARASITIC ELEMENTS

BACKGROUND

The invention relates in general to antennas and more specifically to an apparatus and method for adjusting antenna characteristics using tunable parasitic elements.

Electromagnetic signals are transmitted and received through antennas. The selection or design of an antenna for a particular device may depend on a variety of factors including signal frequencies, antenna performance, and available space. In conventional antenna systems, an antenna is selected and optimized to account for a wide variety of possible situations. Conventional techniques may utilize parasitic elements, sometimes referred to as "brackets", to manipulate antenna characteristics. The selection and adjustment is often a compromise to minimize the susceptibility to anticipated situations such as changes in signal strength, operating frequencies, interference, antenna radiation patterns, and the effects of objects and user body parts when positioned near the device. As a result, maximum performance is rarely achieved for any particular situation.

Accordingly, there is need for an apparatus and method for adjusting antenna characteristics using tunable parasitic elements.

DETAILED DESCRIPTION

In accordance with an exemplary embodiment of the invention, a controller adjusts operational characteristics of an antenna by adjusting one or more tunable parasitic elements based on a quality of electromagnetic signals exchanged with a communication system through the antenna. Near-field characteristics of the antenna are optimized by adjusting one or more of the tunable parasitic elements to change the input impedance of the antenna. Far-field characteristics are optimized by adjusting the one or more tunable parasitic elements to change the radiation pattern to increase transmission gain or to reduce reception gain in a particular region. In the exemplary embodiment, the signal quality parameters include power control signals for transmission optimization and signal to noise (S/N) and total received power measurements for reception optimization. Any of several signal quality parameters measured at the communication system or at the mobile communication device may be used for optimization, however.

Figure 1:
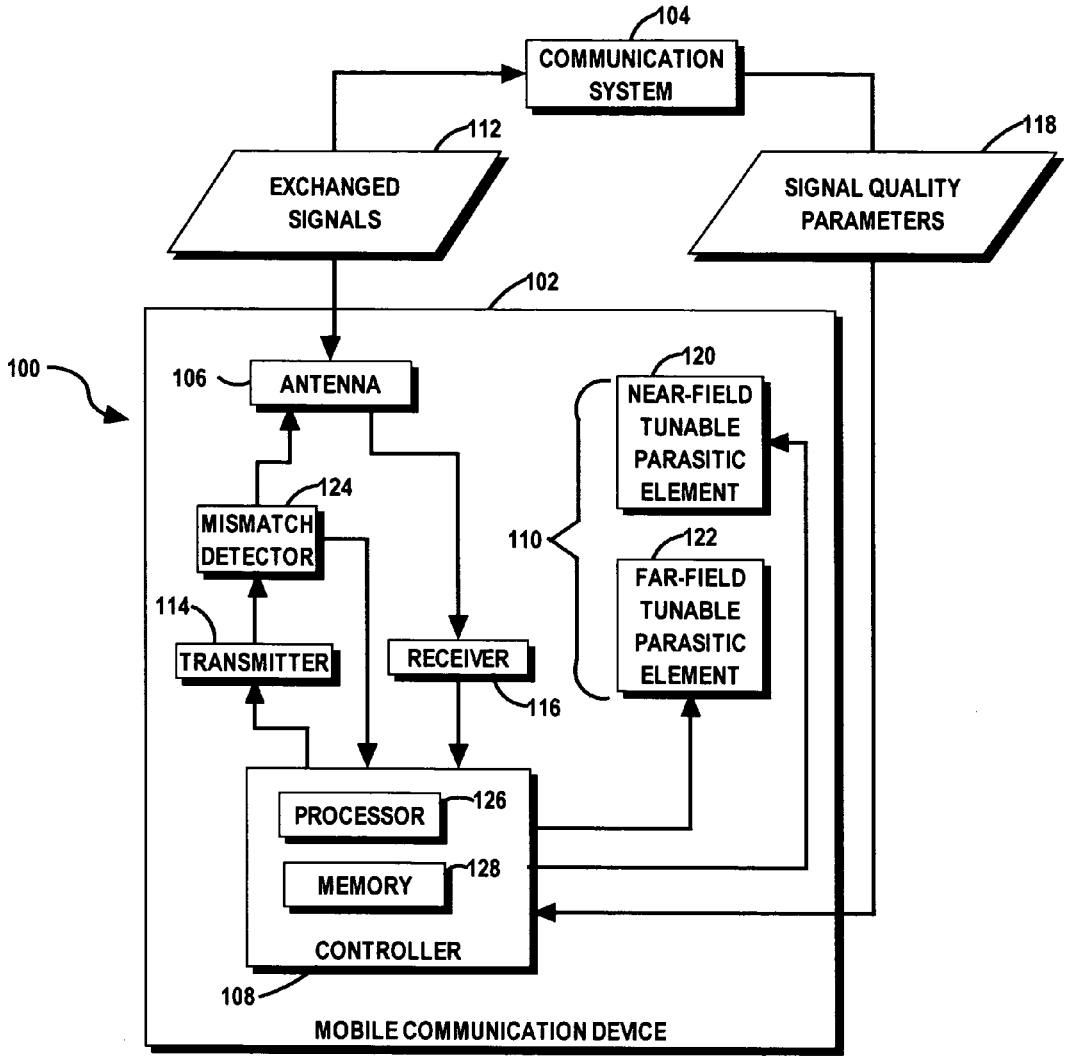
FIG. 1 is a block diagram of a communication device in accordance with an exemplary embodiment of the invention.

FIG. 1 is a block diagram of an antenna system 100 within a mobile communication device 102 for communicating in a communication system 104 in accordance with an exemplary embodiment of the invention. The mobile communication device 102 includes a transmitter 114 and receiver 116 connected to the antenna system 100 and is configured to wirelessly communicate with a communication system 112 through the antenna 106. Data and control signals are transmitted and received by the mobile communication device 102 by transmitting and receiving electromagnetic signals 112 through the antenna 106.

The antenna system 100 may be implemented within any of numerous devices and wireless communication systems where electromagnetic signals are exchanged through an antenna 106. In the exemplary embodiment, the antenna system 100 is part of a mobile communication device 102 operable in accordance with Code Division Multiple Access (CDMA) standards such as CDMA2000. The mobile communication device 102 may be a cellular telephone, wireless modem, personal digital assistant (PDA) or other device that exchanges electromagnetic signals with a fixed or mobile communication device. The mobile communication device 102 may include other hardware, software, or firmware not shown in FIG. 1 for facilitating and performing the functions of a mobile communication device 102. For example, the mobile communication device 102 may include input and output devices such as keypads, displays, microphones and speakers. Further, the functions and operations of the blocks described in FIG. 1 may be implemented in any number of devices, circuits, or elements. Two or more of the functional blocks may be integrated in a single device and the functions described as performed in any single device may be implemented over several devices. For example, the transmitter 114 and the receiver 116 may include and utilize common circuitry or elements in some circumstances.

The antenna system 100 includes at least an antenna 106, a controller 108, and one or more tunable parasitic elements 110. In the exemplary embodiment, the antenna system 100 also includes a mismatch detector 124 that provides information regarding the impedance of the antenna 106. The antenna 106 may be any dipole, patch antenna, Planar Inverted "F" (PIFA), inverted F, monopole, stubby antenna that can transmit and receive the exchanged signals 112 with the communication system 104. The particular antenna 106 is selected based on the operating frequencies and bandwidth, power levels used by the mobile communication device 102, and in accordance with other design parameters such as efficiency, size, impedance, durability, gain, polarization, cost and weight. Examples of suitable antennas include Planar Inverted "F" antenna (PIFA) and monopole antennas such as "stubbies" and extendable whip antennas. The antenna 106 includes a radiator element and a counterpoise formed by a ground plane in the mobile communication device 102. As described below, the near-field and far-field characteristics of the antenna 106 are adjusted and optimized by adjusting tunable parasitic elements 110 that alter currents flowing through the counterpoise.

The mismatch detector 124 provides information regarding the impedance at the input of the antenna 106. In the exemplary embodiment, the mismatch detector 124 indicates the quality of the impedance match between the antenna 106 and other mobile communication device 102 circuitry connected to the antenna 106 such as the transmitter 114. The mismatch detector 124 includes any combination of circuitry and devices that produces one or more mismatch detector signals that can be used by the controller 108 to determine the return loss or impedance at the input of the antenna 106. Examples of suitable mismatch detectors 124 are discussed in U.S. patent application Ser. No. 10/806,763, entitled "Systems And Methods For Controlling Output Power In A Communication Device", filed Mar. 22, 2004 and incorporated by reference in its entirety herein. Examples of mismatch detectors 124 that provide return loss information include mismatch detectors formed using circulators and/or power detectors where two analog signals are produced. One of the signals is an input power signal indicating the input power level at the input of the antenna 106 and the other signal is a reflected power signal indicating the reflected power due to a mismatch in impedance between the antenna 106 input and the transmitter 114 output. Based on the two signals, the controller 108 determines the return loss. As is known, voltages of signals can be measured to determine a voltage standing wave ratio (VSWR) which indicates return loss. An example of a mismatch detector 124 that provides magnitude and phase information includes a mismatch detector including circulator and a slow wave structure that provides two or more signals allowing the controller to determine a magnitude as well as the phase of a signal reflected at the antenna 106 input.

One or more tunable parasitic elements 110 change the operational characteristic of the antenna 106 by altering current flows within a counterpoise of the antenna 106. In the exemplary embodiment, the tunable parasitic elements 110 include at least one near-field tunable parasitic element 120 and at least one far-field tunable parasitic element 122. In some circumstances, one or more of the matching tunable parasitic elements 120 may also be a far-field tunable parasitic element 122. Further, a single tunable parasitic element 110 may be used both as the near-field tunable parasitic element 120 and as the far-field tunable parasitic element 122. Accordingly, the term "tunable parasitic element 110," collectively refers to any number and combination of matching tunable parasitic elements 120 and far-field tunable parasitic elements 122.

In the exemplary embodiment, near-field characteristics of the antenna 106 are changed by adjusting the near-field tunable parasitic element 120 and far-field antenna characteristics are changed by adjusting the far-field tunable parasitic element 122. As explained below in further detail, the exemplary technique of changing the near-field characteristics includes changing an impedance of the antenna 106 based on information received from a mismatch detector 124. Based on the quality of the electromagnetic signals exchanged through the antenna, the controller 108 produces a tuning signal to tune the far-field tunable parasitic element 122. In the exemplary embodiment, the signal quality parameters comprise power control signals during transmission. During reception, the power and signal to noise ratio (S/N) of the received signal provide the quality indicators. Other measurements and parameters can be used in some circumstances to determine the quality of a transmitted or received signal. The parameters may be measured by mobile communication device 102 or by equipment in the communication system 112. Information based on the communication system 112 measurements is forwarded to the mobile communication device 102 by transmitting signals through the wireless communication link between the communication system 112 and the mobile communication device 102. Examples of other signal quality parameters include bit error rate (BER) measurements.

The controller 108 is any device, circuit, integrated circuit (IC), application specific IC (ASIC), or other configuration including any combination of hardware, software and firmware that performs the functions described herein as well as facilitating the over functionality of the mobile communication device 102. In the exemplary embodiment, the controller 108 includes a processor 126 and a memory 128. The processor 126 is any computer, processor, microprocessor, or processor arrangement that executes software code to perform the calculation and control functions described herein. The memory 128 is any memory device, IC, or medium suitable for storing code and data that can be accessed by the processor 126. The controller 108 may include other devices, circuits and elements not shown in FIG. 1 that facilitate the exchange of signals and perform other interface functions. For example, the controller 108 includes analog to digital (A/D) converters in some circumstances for sampling and converting the analog signals received at the controller 108. Also, the controller 108 includes digital to analog (D/A) converters to provide analog control signals to the tunable parasitic elements 110 in some circumstances.

As discussed in further detail below, the controller 108 performs an adjustment procedure to tune one or more parasitic elements 110 to change an antenna impedance, transmission pattern, or reception pattern. In the exemplary embodiment, near-field characteristics such as impedance are optimized before far-field characteristics such as radiation pattern shapes are optimized for a particular situation. After far-field characteristics are optimized by adjusting the far-field tunable parasitic element 122, the output of the mismatch detector 124 is evaluated to determine if further antenna impedance adjustment is advantageous.

Figure 2:
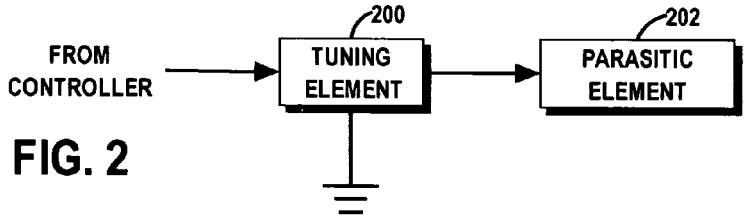
FIG. 2 is a block diagram of a tunable parasitic element in accordance with the exemplary embodiment of the invention.

FIG. 2 is a block diagram of an exemplary tunable parasitic element 110. The tunable parasitic element 110 includes a tuning element 200 and a parasitic element 202. The parasitic element 202, sometimes referred to as a "bracket", is any section of wire, sheet metal, conductive strip, or other electrically conductive material having an electrical length that can be expressed as a multiple or sub-multiple of a wavelength of an electromagnetic or electrical signal propagating through the parasitic element 202. The electrical length, therefore, is proportional to the frequency of the signals affected by the parasitic element 202. The electrical length is dependent on the dielectric constant of the printed circuit board on which the parasitic element 202 is mounted. During operation, the parasitic element 202 alters radiation-induced current flows within a counterpoise, such as printed circuit board layer.

The tuning element 200 is any switch, variable impedance device, or any combination of switches and variable impedance devices that are responsive to a control signal. Examples of suitable devices that can be used to form the tuning element 200 include coupling elements such as field effect transistors (FETs), bipolar transistors, PIN diodes, ferroelectric capacitors, varactor diodes, and microelectromechanical systems (MEMS) switches. In addition to an electrical length, the tuning element 200 has a variable impedance component such as reactance or imaginary impedance component. By presenting the appropriate control signal, the parasitic element 202 is incorporated into the system by electrically coupling the tunable parasitic element 110 to the counterpoise, to one or more other tunable parasitic elements, or to both. Exemplary tunable parasitic elements 110 and parasitic element 110 configurations are discussed in further detail in U.S. patent application Ser. No. 10/940,206, entitled "Wireless Device Reconfigurable Radiation Desensitivity Bracket Systems and Methods" and U.S. patent application Ser. No. 10/940,702, entitled "Wireless Device Reconfigurable Radiation Desensitivity Bracket Systems and Methods", both filed Sep. 14, 2004 and incorporated by reference in their entirety herein.

Figure 3:
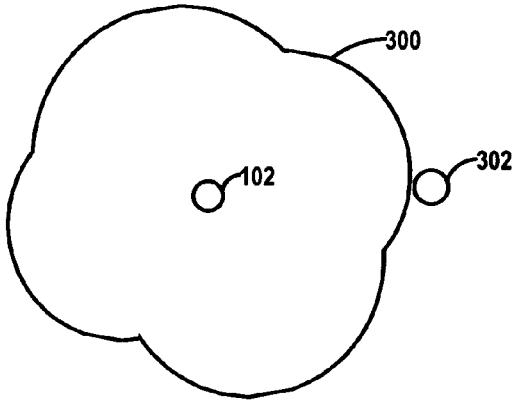
FIG. 3 is a schematic cross-sectional representation of an exemplary far-field transmission pattern of the mobile device after near-field characteristics are optimized.
Figure 4:
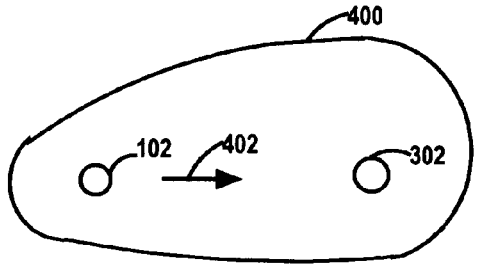
FIG. 4 is a schematic representation of a transmission pattern of the mobile communication device after far-field transmission characteristics are optimized.
Figure 5:
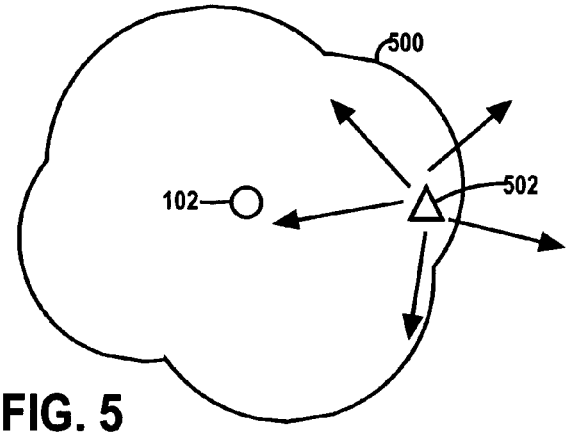
FIG. 5 is a schematic cross-sectional representation of an exemplary far-field reception pattern of the after the near-field characteristics are optimized.
Figure 6:
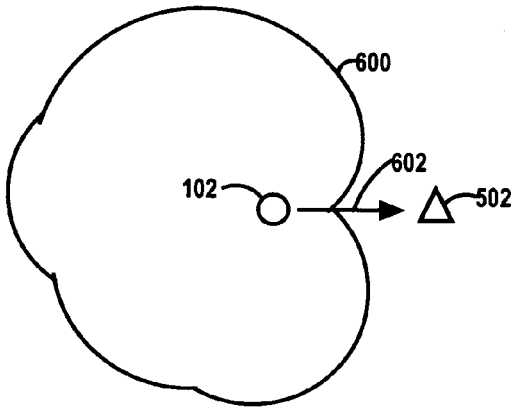
FIG. 6 is a schematic representation of a reception pattern of the mobile communication device after far-field reception characteristics are optimized.

FIG. 3, FIG. 4, FIG. 5, and FIG. 6 are schematic representations of top views of exemplary far-field radiation patterns. FIG. 3 and FIG. 4 represent exemplary transmission patterns and FIG. 5 and FIG. 6 represent exemplary reception patterns. Since radiation patterns are three dimensional, the figures show a two dimensional cross-section of the radiation pattern. In some circumstances, a reception pattern may be the same as the transmission pattern for a particular antenna. The far-field radiation patterns are depicted as shaped lines forming a perimeter around the mobile device 102. Where the radiation pattern represents a transmission pattern, the line represents a constant transmission gain and where the radiation pattern represents a reception pattern, the line represents a constant reception gain of the antenna 106. The line representing the radiation pattern represents a particular value above or below a reference level. For example, where the radiation pattern is a transmission pattern, the line may represent a transmission gain of −60 dB relative to a power level of an input signal injected into the antenna. Where the radiation pattern is a reception pattern, the line may indicate a relative power level at an output of an antenna as compared to a signal transmitted from a position along the line. Radiation patterns may represent a variety relative gains, power levels, losses, and other parameters depending on the particular situation. Comparisons and analysis of radiation patterns should account for transmitter gains as well as receiver sensitivities. In some situations, the radiation pattern represents a transmission or reception gain relative to an isotropic antenna in units of dBi. For example, the line may represent −1 dBi indicating that the gain is 1 dB below an omni-directional antenna at 100% efficiency.

The FIG. 3 is a schematic cross-sectional representation of an exemplary far-field transmission pattern 300 of the mobile device 102 after near-field antenna characteristics have been adjusted. The far-field transmission pattern may have any of numerous shapes in the after the near-field characteristics are optimized. The shape of the pattern in most circumstances is generally uniform with the antenna near the center of the shape. The curved line representing transmission pattern in FIG. 3 corresponds to the same transmission gain as the curved line representing the transmission pattern in FIG. 4. For the following example, the transmission pattern represents a minimum transmission gain of the antenna required for acceptable communication with the communication device 302. As shown in FIG. 3, a communication device 302 such a base station is not within the transmission pattern 300 before far-field characteristics are optimized. Since the device 302 is outside the pattern, acceptable communication can not occur without a change in the relative position between the mobile communication device 102 and the communication device 302 or a change in the transmission pattern 300.

In the exemplary embodiment, the controller 108 optimizes the near-field antenna characteristics during power-up and during operation based on impedance matching information received from the mismatch detector 124. As explained in further detail below, the controller 108 generates the appropriate control signal to adjust the near-field tunable parasitic element 120 resulting in a better impedance match between the antenna and other circuitry such as the transceiver. Accordingly, after the near-field characteristics are optimized, the radiation efficiency is optimized thereby increasing the total radiated power (TRP) and the total isotropic sensitivity (TIS). After the optimization of the near-filed characteristics, performance is further improved in the exemplary embodiment by optimizing the far-field antenna characteristics.

FIG. 4 is a schematic representation of a radiation pattern 400 of the mobile communication device 102 after the far-field antenna performance has been optimized for transmission. Based on signal quality parameters, the controller 108 generates a far-field control signal, such as an analog, direct current (DC) signal, to adjust the far-field tunable parasitic element 122. In some situations, multiple far-field control signals may be generated to adjust multiple far-field tunable parasitic elements 122. The signal quality parameters may include any number and combination of measured and calculated parameters. In the exemplary embodiment, the signal quality parameters 118 used for far-field transmission optimization include power control signals received from the communication system 104. Adjusting the far-field tunable parasitic element 122 varies the currents in the antenna 106 counterpoise to change the radiation pattern from the transmission pattern 300 to the transmission pattern 400. The transmission gain in the direction 402 of the receiver 116 of the base station 302 is increased allowing base station to receive the signals transmitted from the mobile communication device 102.

The FIG. 5 is a schematic cross-sectional representation of an exemplary far-field reception pattern 500 of the mobile device 102 after the near-field characteristics are optimized. The far-field reception pattern may have any of numerous shapes in the standard mode. A reception pattern line in FIG. 5 represents the same reception gain as the reception pattern line in FIG. 6. A jamming transmitter 502 such as another mobile communication device or a base station is sufficiently close to the mobile communication device 102 to cause jamming interference. The jamming transmitter 502 may be communicating with other devices or equipment within the same frequency band as the frequency band used by the mobile communication device 102 for receiving signals. As a result, the mobile communication device 102 will detect a relatively high power signal from the jamming transmitter 502 but experience a poor signal to noise (S/N) ratio for the received signals. For the following example, the reception pattern 500 represents a reception gain of the antenna 106 that results in interference from the jamming transmitter 502. The triangle representing the jamming transmitter 502 is shown within the reception pattern 500 in FIG. 5 to indicate that the jamming transmitter 502 is causing interference that is degrading reception performance of the mobile communication device 102.

FIG. 6 is a schematic representation of a reception pattern 600 of the mobile communication device 102 after the far-field antenna performance has been optimized for reception. Based on signal quality parameters measured at the mobile communication device 102, the controller 108 generates a far-field control signal to adjust at least one far-field tunable parasitic element 122. The resulting reception pattern is shaped to reduce reception gain in the direction 602 of the jamming transmitter 502. As discussed in further detail below, the controller 108 generates the far-field control signal based on total received power and the signal to noise ratio of the received signal in the exemplary embodiment.

Figure 7:
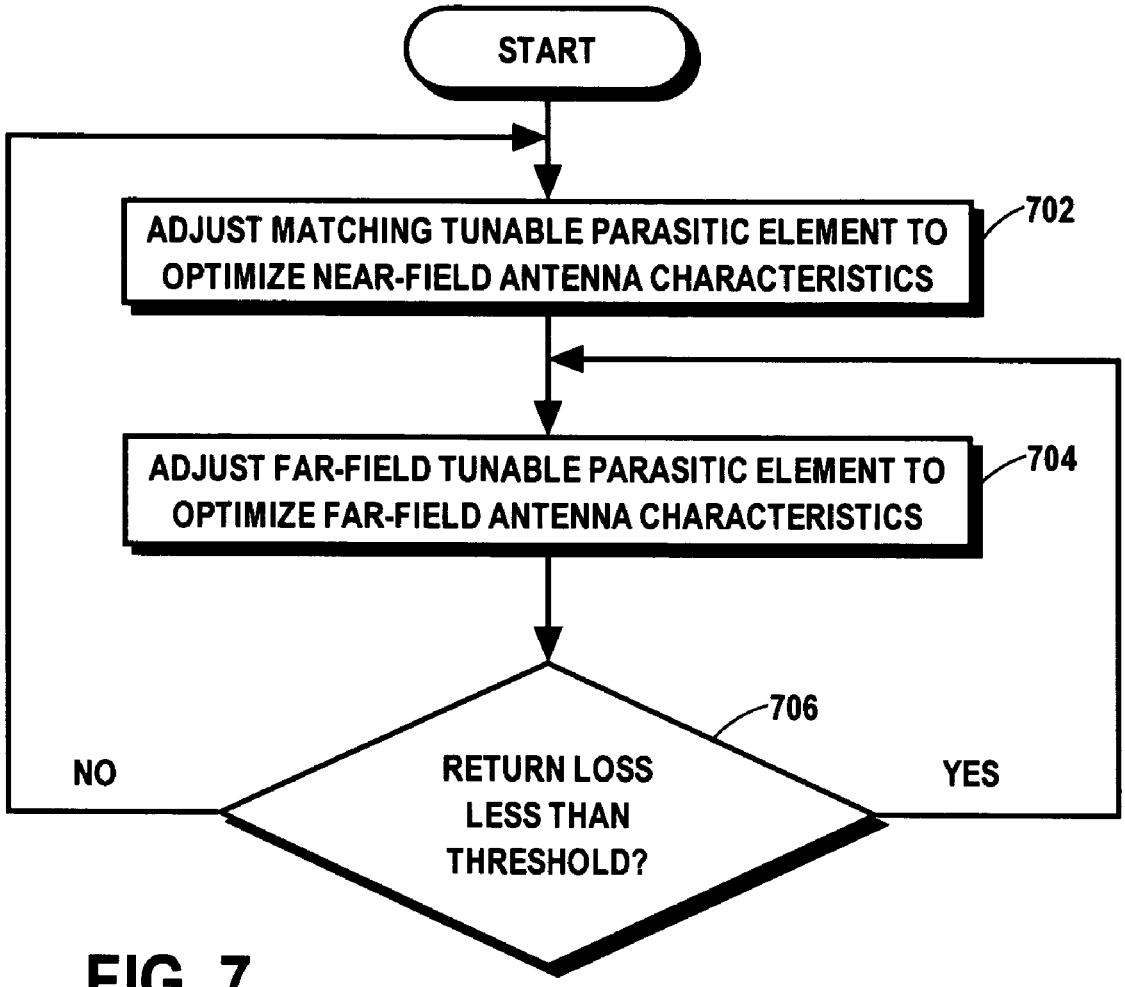
FIG. 7 is a flow chart of a method of adjusting operational characteristics of an antenna.

FIG. 7 is a flow chart of a method of adjusting operational characteristics of antenna in a mobile communication device 102 in accordance with the exemplary embodiment of the invention. The method may be performed in any wireless communication device having an antenna system 100. In the exemplary embodiment, the method discussed with reference to FIG. 7 is performed in a mobile communication device 102 and includes executing software code in the controller 108.

At step 702, the near-field tunable parasitic element 120 is adjusted to optimize the near-field antenna characteristics. In the exemplary embodiment, the controller 108 generates a matching control signal to adjust the matching tunable parasitic element. Based on the signals received from the mismatch detector 124, the controller 108 determines the appropriate voltage to apply to the tuning element 200 of the near-field tunable parasitic element 120. In the exemplary embodiment, a look-up table is stored in memory correlates mismatch detector 124 output signals with one or more matching control signal values to adjust the impedance of the antenna 106. Since the appropriate matching signals depend on frequency, the look-up table is a three dimensional table or multiple look-up tables are stored where each look-up table is associated with a particular frequency band or channel. As described in further detail below, the controller 108 may perform an iterative, trial an error, procedure where a particular mismatch detector value is associated with multiple matching signals. Depending at least partially on the particular type of mismatch detector 124, the controller 108 may shift the return loss curve to position the minimum at the operating frequency or reduce the minimum as well as shift the position of the minimum. Two exemplary techniques for performing step 702 are discussed below with reference to FIG. 8 and FIG. 9.

At step 704, the far-field tunable parasitic element 122 is adjusted to optimize the far-field antenna characteristics. The controller 108 generates a far-field control signal to adjust the far-field tunable parasitic element 122 based on signal quality parameters 118 received from the communication system 104 for transmission antenna characteristics. Far-field reception characteristics are generated based on quality indicators measured at the mobile communication device 102. In the exemplary embodiment, the controller 108 determines the appropriate far-field signal for transmission based on the power control signals received from communication system 104. In some circumstances, other system parameters may be used to generate the far-field signals for transmission. For example, bit error measurements or signal to noise (S/N) measurements may be used. Exemplary techniques for performing step 704 are discussed below with reference to FIG. 10.

At step 706, the controller 108 determines if further adjustment of near-field antenna characteristics is advantageous. In the exemplary embodiment, the controller 108 compares the return loss measured by the mismatch detector 124 to a threshold. The procedure returns to step 704 is the return loss is greater than the threshold where the antenna impedance is optimized. Otherwise, the procedure returns to step 704 where the controller 108 continues to optimize the far-field characteristics.

Figure 8:
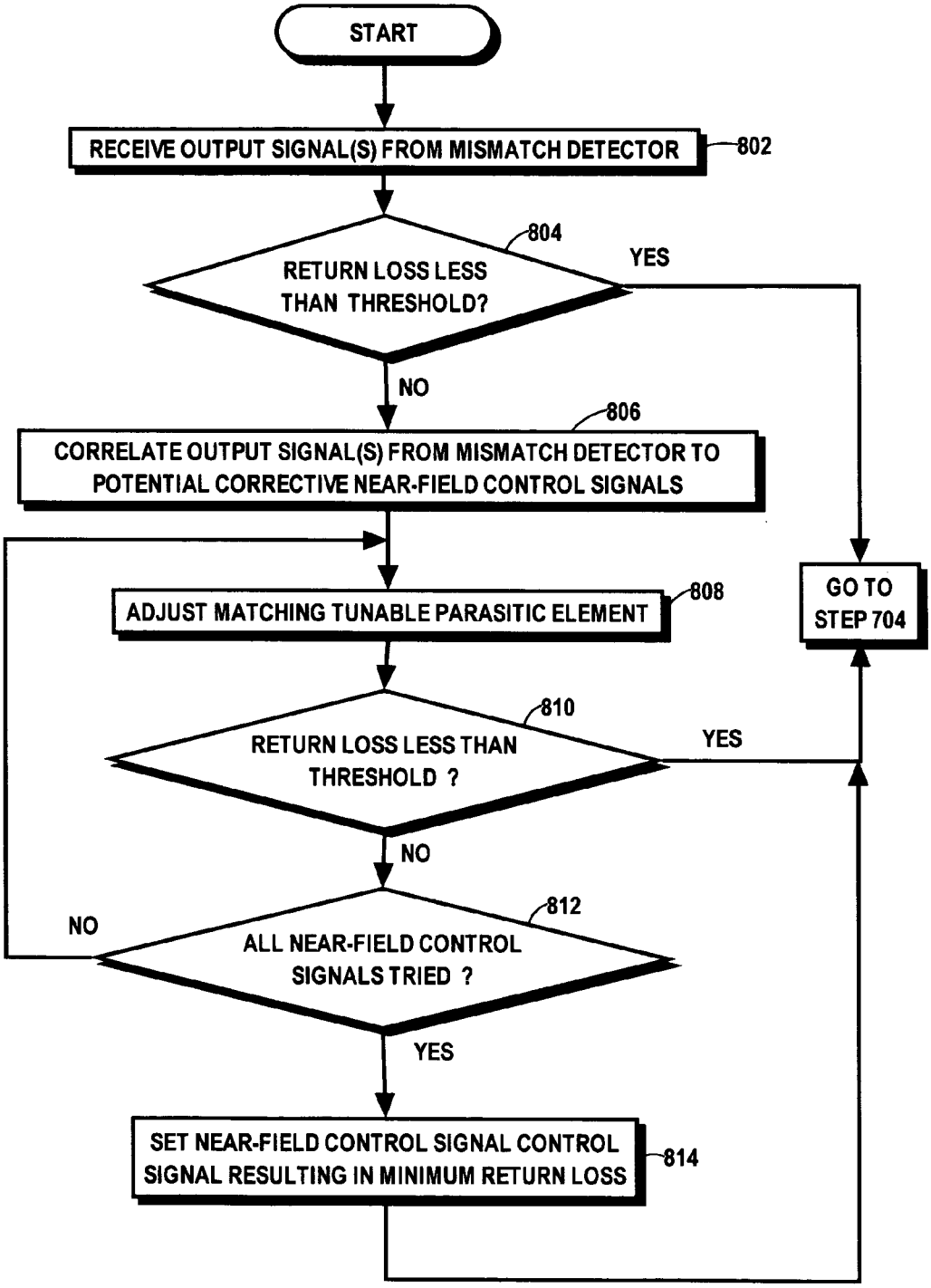
FIG. 8 is a flow chart of an exemplary method of adjusting near-field antenna characteristics where the mismatch detector provides return loss information.

FIG. 8 is a flow chart of an exemplary method of performing step 702 of FIG. 7 where the mismatch detector provides information related to the magnitude of the return loss.

At step 802, the output signal of the mismatch detector 124 is received. The received information from the mismatch detector 124 indicates the ratio of reflected power to the total power injected into the antenna 106. In the exemplary embodiment, the mismatch detector 124 provides two analog signals where one signal is proportional to the total power at the antenna 106 produced by an amplifier in the transmitter 114 and the other signal is proportional to the reflected power reflected from the antenna input. The controller 108 calculates the magnitude of the return loss based on the two signals. Other mismatch detectors 124 can be used to determine the magnitude of the return loss where the information may be provided using one or more analog or digital signals.

At step 804, the controller 108 determines if the return loss is less than a return loss threshold. In the exemplary embodiment, the return loss threshold is stored in memory 128 retrieved by the processor 126 and compared to the measured return loss at the antenna 106. If the measured return loss is less than the return loss threshold, the process continues at step 704. Otherwise, the procedure continues at step 806.

At step 806, the information received from the mismatch detector 124 is correlated to potential near-field control signals. In the exemplary embodiment, the analog output signals from the mismatch detector 124 are sampled and compared to values in a look-up table that is stored in memory 128. The values in the look-up table are related to frequency. Accordingly, the look-up table is a three dimensional table or multiple tables are used to represent the potential situations at different frequencies. In the exemplary embodiment, the look-up tables are created by experimentally determining the optimum near-field control signal for numerous situations. For example, the near-field tunable parasitic element is adjusted for optimum performance when a representative mobile communication device 102 is held by user in a particular position. The output of the mismatch detector 124 is recorded and an iterative process of adjusting the near-field tunable parasitic element is performed until the optimum impedance match is determined. The resulting near-field control signal is associated with the original mismatch detector 124 signal and the operating frequency. The process is repeated for numerous situations and positions to create one or more look-up tables representing the most likely situations that will be encountered by the mobile communication device 102 during operation. The tables are stored in memory 128 during manufacturing process. Other techniques may be used to store information correlating the antenna 106 near-field performance to near-field control signals. The stored information stored may directly correlate mismatch detector signals to near-field control signals or may provide information allowing the controller 108 to perform calculations to determine the optimum near-field control signal. During operation, the controller 108 identifies one or more potential near-field control signals from the information of the look-up table.

In some situations, the controller 108 performs additional calculations to determine the optimum control signal where the mismatch detector 124 indicates a magnitude and phase of the reflected signal. For example, where phase information is available the controller 108 can calculate the appropriate compensation impedance to improve the impedance match. Such a procedure can be modeled as a route through a Smith Chart. As is known, a Smith Chart is geographical calculator that provides a visual representation of the relationship between normalized impedances replacing complex algebraic calculations. By appropriately tuning and introducing the near-field tunable parasitic elements 120, the real and imaginary portions of the antenna 106 impedance are guided toward the impedance of the transmitter 114 improving the impedance match and the near-field antenna performance. Where the controller 108 calculates the appropriate impedance adjustment, the controller 108 performs complex computations simulating the paths through a Smith Chart.

At step 808, the controller 108 generates the near-field control signal to adjust the near-field tunable parasitic element. Where multiple control signals are identified, the controller 108 selects one the signals. The selection may be based on a weighting procedure that evaluates the potential signals in some circumstances. In the exemplary embodiment, at least two near-field tunable parasitic elements 120 are used to optimize the near-field characteristics where the mismatch detector 124 provides magnitude and phase information.

At step 810, the controller 108 determines if the return loss is less than the return loss threshold. If the measured return loss is less than the return loss threshold, the process continues at step 704. Otherwise, the mismatch detector 124 output is stored and the procedure continues at step 812.

At step 812, it is determined if all near-field control signals have been tried. If all near-field control signals have not been tried, the procedure returns to step 808 where the matching element is adjusted using another near-field control signal. The process continues until either the return loss is less than the return loss threshold or all control signals have been attempted. When all near-field control signals have been attempted and the return loss is not less than the threshold, the process continues at step 814.

At step 814, the controller 108 uses the near-field control signal that resulted in the lowest return loss to adjust the near-field tunable parasitic element 122. The procedure then continues at step 704.

Figure 9:
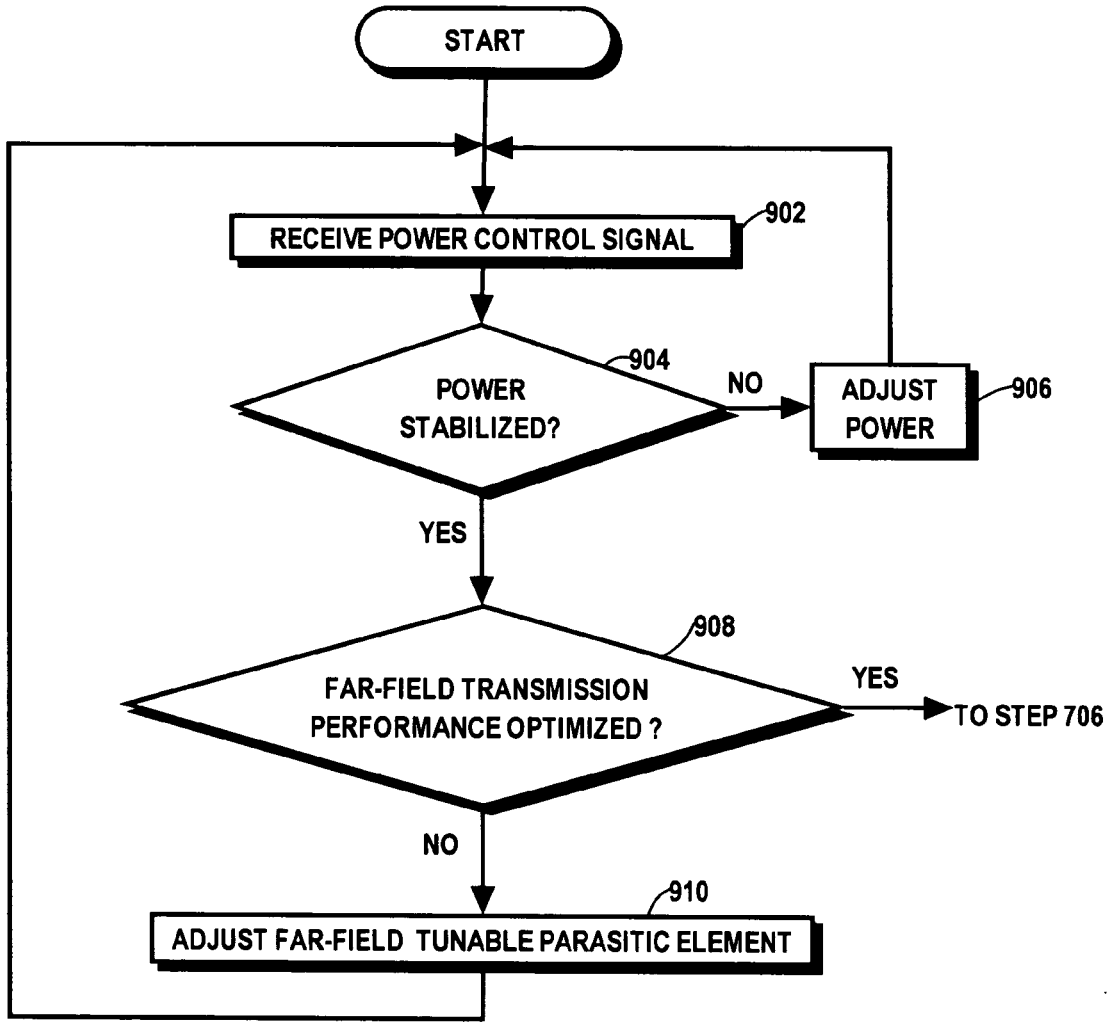
FIG. 9 is a flow chart of an exemplary method of adjusting near-field antenna characteristics where the mismatch detector provides magnitude and phase information.

FIG. 9 is a flow chart of an exemplary method of performing step 704 of FIG. 7 where the far-field antenna characteristic is a transmission characteristic. The exemplary method discussed with reference to FIG. 9 is performed in a mobile communication device 102 such as mobile station operating in a CDMA communication system.

At step 902, the mobile communication device 102 receives a power control signal from the communication system 104. In accordance with CDMA protocols the communication system transmits power-up and power-down commands using control signals. Therefore, the signal quality parameters 118 in the exemplary method are power control signals transmitted as part of the exchanged signal 112 between the communication system 104 and the mobile communication device 102.

At step 904, the controller 108 determines if the output power of the mobile station is stabilized. In the exemplary embodiment, the controller 108 maintains a running history of the power control signals and determines that the power has stabilized when a sufficient number of alternating power control signals are received. When the mobile communication device 102 is operating near the appropriate power level the communication system alternates between power-up and power-down commands. Any of several techniques, may be used to determine when the power level has stabilized and power control signals are alternating. For example, the controller 108 may calculate a running average of the power control signals for sequence length. If the power has not stabilized, the power is adjusted in accordance with the last power control signal at step 906 and the method then returns to step 902. If the power has stabilized, the method continues at step 908.

At step 908, the controller 108 determines if the far-field antenna characteristics have been optimized. Any of several techniques and decision criteria may be used to determine if far-field transmission performance has been optimized. The controller 108 determines the optimization has been achieved if any time during the process it is determined that the transmission power set at the lowest level. In the exemplary embodiment, performs an iterative process of minimizing the transmission power. For each attempted far-field control signal, the stabilized power level is stored in memory and associated with the control signal.

At step 910, the far-field tunable parasitic element 122 is adjusted with the far-field control signal. The procedure returns to step 902, where the next power control signal is received. After the power is stabilized the power level is recorded and the next control signal is evaluated by steps 908. The process continues until minimum power level is determined or the transmitter 114 is set at the lowest power level. When the far-field transmission antenna performance is optimized, the method continues at step 706.

Figure 10:
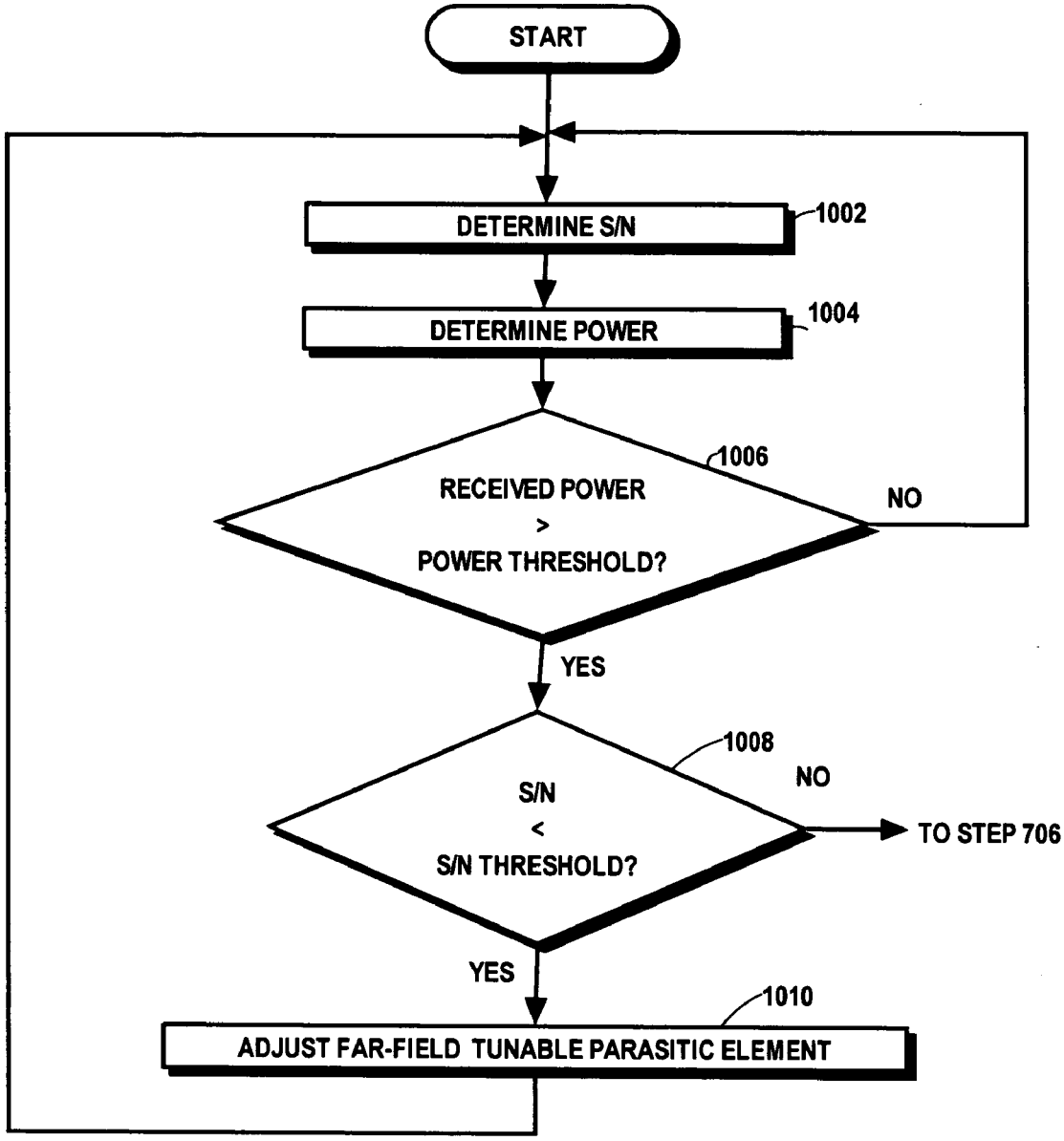
FIG. 10 is a flow chart of an exemplary method of adjusting far-field transmission characteristics.

FIG. 10 is a flow chart of an exemplary method of performing step 704 of FIG. 7 where the far-field antenna characteristic is a reception characteristic. In the exemplary embodiment, the controller 108 performs an iterative processes to maximize the quality of a received signal by minimizing the interference due to a jamming transmitter 502.

At step 1002, the controller 108 determines the signal to noise ratio (S/N) of the received signal. Any of several techniques may be used to determine S/N. An example of a suitable technique for determining the signal-to-noise ratio includes determining the. Received Signal Strength Indicator (RSSI). RSSI is equal to received power multiplied by the combined pilot energy per chip (Ec) divided by the total received power spectral density (noise, signal and interference), known as $I_o$.

At step 1004, the controller 108 determines the total power received through the antenna. In the exemplary embodiment, a power sensor determines when the amplified received signals that are amplified by an amplifier are at the appropriate level. The gain of the amplifier is controlled using a control signal based on the resulting power level. The control signal is monitored to determine the quality of the received signal.

At step 1006, the controller 108 determines if far-field reception performance have been optimized. Any of several techniques and decision criteria may be used to determine if far-field reception performance has been optimized. In the exemplary embodiment, the controller 108 determines that optimization has been achieved if any time during the process it is determined that the total received power is below a received power threshold. The controller 108 performs an iterative process of minimizing the received power while maintaining maximizing the S/N. For each attempted far-field tunable parasitic element 122 configuration (i.e. each far-field control signal), the resulting received power and S/N is stored in memory and associated with the particular control signal. When the controller 108 determines that all configurations have been attempted, the controller 108 generates the far-field control signals associated with the minimum received power with acceptable S/N. Where a jamming transmitter 502 is located near the mobile communication station 102, the resulting reception pattern 600 will include decreased reception gain in the direction 602 of the jamming transmitter 502. If the controller 108 determines that the far-field reception performance has not been optimized, the procedure continues at step 1008 where the far-field tunable parasitic element 122 is adjusted to a new configuration before returning to step 1002 to continue the evaluation.

In the exemplary embodiment, therefore, the controller 108 in the mobile communication device 102 generates control signals to adjust tunable parasitic elements 110 to change antenna characteristics and optimize near-field and far-field antenna performance. Near-field tunable parasitic elements are tuned to minimize return loss based on information received from the mismatch detector 124. Based on signal quality parameters, one or more far-field tunable parasitic elements 122 are tuned to optimize the radiation patterns during transmission and reception. Using power control signal transmitted from the base station 302 as the signal quality parameters, the controller 108 increases the transmission gain in the direction 402 of the based station 302 during transmission. During reception, the S/N and power measurements are used by the controller 108 to minimize reception gain in the direction 602 of a jamming transmitter 502.

Clearly, other embodiments and modifications of this invention will occur readily to those of ordinary skill in the art in view of these teachings. The above description is illustrative and not restrictive. This invention is to be limited only by the following claims, which include all such embodiments and modifications when viewed in conjunction with the above specification and accompanying drawings. The scope of the invention should, therefore, be determined not with reference to the above description, but instead should be determined with reference to the appended claims along with their full scope of equivalents.

What is claimed is:

1. An antenna system comprising:

an antenna configured to exchange an electromagnetic signal with a communication system;

a parasitic element tunable to change an operational characteristic of the antenna in accordance with a control signal; and a controller configured to produce the control signal based on a signal quality parameter.

2. An antenna system in accordance with claim 1, wherein the electromagnetic signal is a transmitted signal transmitted through the antenna and the signal quality parameter comprises a power control signal received from the communication system.

3. An antenna system in accordance with claim 2, wherein the parasitic element comprises a far-field tunable parasitic element, the controller further configured to increase a transmission gain in a direction of a receiver of the communication system by generating a far-field control signal to adjust the far-field tunable parasitic element.

4. An antenna system in accordance with claim 3, where the parasitic element further comprises a near-field tunable parasitic element, the controller further configured to change an impedance of the antenna by generating a near-field control signal to adjust the near-field tunable parasitic element.

5. An antenna system in accordance with claim 1, wherein the electromagnetic signal is a received signal received through the antenna and the signal quality parameter comprises a signal to noise of the received signal.

6. An antenna system in accordance with claim 1, wherein the electromagnetic signal is a received signal received through the antenna and the signal quality parameter comprises a signal to noise (S/N) of the received signal and a total power of signals received at the antenna.

7. An antenna system in accordance with claim 6, wherein the parasitic element comprises a far-field tunable parasitic element, the controller further configured to decrease a reception gain in a direction of a jamming transmitter by generating a far-field control signal to adjust the far-field tunable parasitic element.

8. An antenna system in accordance with claim 7, where the parasitic element further comprises a near-field tunable parasitic element, the controller further configured to change an impedance of the antenna by generating a near-field control signal to adjust the near-field tunable parasitic element.

9. A method of optimizing antenna performance comprising:

receiving a signal quality parameter from a communication system; and adjusting, based on the signal quality parameter, a tunable parasitic element to change an operational characteristic of an antenna, wherein the signal quality parameter comprises a power control signal, wherein the tunable parasitic element comprises a far-field tunable parasitic element and wherein the adjusting comprises adjusting the far-field tunable parasitic element to increase transmission gain in a direction of a receiver of the communication system.

10. A method in accordance with claim 9, further comprising:

adjusting a near-field tunable parasitic element to change an impedance of the antenna.

11. A method of optimizing antenna performance comprising:

measuring a signal quality parameter at an antenna; and adjusting, based on the signal quality parameter, a tunable parasitic element to change an operational characteristic of the antenna, wherein the signal quality parameter comprises a signal to noise ratio (S/N) or a received signal and a total power of signal received at the antenna.

12. A method in accordance with claim 11, wherein the tunable parasitic element comprises a far-field tunable parasitic element and wherein the adjusting comprises adjusting the far-field tunable parasitic element to decrease reception gain in a direction of a jamming transmitter.

13. A method in accordance with claim 12, further comprising:

adjusting a near-field tunable parasitic element to change an impedance of the antenna.

14. A mobile communication device comprising:

an antenna configured to transmit transmitted signals and to receive received signals;

a far-field tunable parasitic element configured to change a far-field characteristic of the antenna in accordance with a far-field control signal;

a receiver configured to receive the received signals from a base station in a communication system, a transmitter configured to transmit the transmitted signals to the base station; and a controller configured to produce the far-field control signal based on a signal quality parameter.

15. A mobile communication device in accordance with claim 14, wherein the signal quality parameter is received from the communication system.

16. A mobile communication device in accordance with claim 15, wherein the signal quality parameter comprises a power control signal and the controller is further configured to increase a transmission gain in a direction of a the base station by generating the far-field control signal based on the power control signal.

17. A mobile communication device in accordance with claim 16, further comprising a near-field tunable parasitic element, the controller further configured to change an impedance of the antenna by generating a near-field control signal to adjust the near-field tunable parasitic element.

18. A mobile communication device in accordance with claim 14, wherein the signal quality parameter is measured at the mobile communication device.

19. A mobile communication device in accordance with claim 18, wherein the signal quality parameter comprises a signal to noise ratio (S/N) of the received signal and total power received at the antenna.

20. A mobile communication device in accordance with claim 19, wherein the controller is further configured to decrease a reception gain in a direction of a jamming transmitter by generating the far-field control signal based on the S/N of the received signals and the total power received at the antenna.

21. A mobile communication device in accordance with claim 20, further comprising a near-field tunable parasitic element, the controller further configured to change an impedance of the antenna by generating a near-field control signal to adjust the near-field tunable parasitic element.

* * * * *